US005662181A

United States Patent [19]

Williams et al.

[11] Patent Number: 5,662,181

[45] Date of Patent: Sep. 2, 1997

[54] ROTATING BLOWOUT PREVENTER

[76] Inventors: John R. Williams, 3816 Spring Mountain Rd., Ft. Smith, Ak. 72901; Vinson D. Williams, Rte. 4 box 391, Muldrow, Okla. 74948

[21] Appl. No.: 735,050

[22] Filed: Oct. 22, 1996

Related U.S. Application Data

[63] Continuation of Ser. No. 653,597, May 24, 1996, abandoned, which is a continuation of Ser. No. 564,933, Nov. 30, 1995, abandoned, which is a continuation of Ser. No. 489,233, Jun. 12, 1995, abandoned, which is a continuation of Ser. No. 310,035, Sep. 21, 1994, abandoned, which is a continuation of Ser. No. 954,285, Sep. 30, 1992, abandoned.

[51] Int. Cl.[6] ..... E21B 3/02

[52] U.S. Cl. ..... 175/195; 166/84.3

[58] Field of Search ..... 175/195; 166/82, 166/84.3

[56] References Cited

U.S. PATENT DOCUMENTS

| | | | |
|---|---|---|---|
| D. 282,073 | 1/1986 | Bearden et al. | D15/21 |
| 517,509 | 4/1894 | Williams . | |
| 1,157,644 | 10/1915 | London . | |
| 1,472,952 | 11/1923 | Anderson . | |
| 1,503,476 | 8/1924 | Childs et al. . | |
| 1,528,560 | 3/1925 | Myers et al. . | |
| 1,546,467 | 7/1925 | Bennett . | |
| 1,560,763 | 11/1925 | Collins . | |
| 1,700,894 | 2/1929 | Joyce et al. . | |
| 1,708,316 | 4/1929 | MacClatchie . | |
| 1,769,921 | 7/1930 | Hansen . | |
| 1,776,797 | 9/1930 | Sheldon . | |
| 1,813,402 | 7/1931 | Hewitt . | |
| 1,831,956 | 11/1931 | Harrington . | |
| 1,836,470 | 12/1931 | Humason et al. . | |
| 1,902,906 | 3/1933 | Seamark . | |
| 1,942,366 | 1/1934 | Seamark | 166/14 |
| 2,036,537 | 4/1936 | Otis | 255/1 |
| 2,071,197 | 2/1937 | Burns et al. | 286/26 |
| 2,124,015 | 7/1938 | Stone et al. | 166/15 |
| 2,126,007 | 8/1938 | Guiberson et al. | 255/1 |
| 2,144,682 | 1/1939 | MacClatchie | 255/1 |
| 2,163,813 | 6/1939 | Stone et al. | 166/14 |
| 2,165,410 | 7/1939 | Penick et al. | 255/1 |
| 2,170,915 | 8/1939 | Schweitzer | 286/16 |
| 2,170,916 | 8/1939 | Schweitzer et al. | 255/1 |

(List continued on next page.)

OTHER PUBLICATIONS

Bourgoyne, Adam T., Jr.–"Rotating Control Head Applications Increasing", Oil & Gas Journal, Oct. 9, 1995.

Hannegan, Don. Williams Tool Company, Inc. Communication, The Brief, Jan. 1996, pp. 26–27.

Williams Tool Co., Inc. Sales Brochure for Rotating Control Heads and Strippers for Air, Gas, Mud and Geothermal Drilling, 1991.

Williams Tool Co., Inc. Sales Brochure, 1982.

Williams Rotating Control Heads Sales Brochure(with Model 7000 Series), 1995.

Williams Tool Company, Inc. International Sales Brochure—Model 7000 Rotating Control Head, 1991.

Williams Tool Company, Inc. Rotating Control Heads Sales Brochure, 1989.

Williams Tool Company, Inc. Instructions—Assemble and Disassemble, Model 9000 Bearing Assembly.

*Primary Examiner*—Hoang C. Dang

*Attorney, Agent, or Firm*—Pravel, Hewitt, Kimball & Krieger

[57] ABSTRACT

A rotating blowout preventor having at least two rotating stripper rubber seals which provide a continuous seal about a kelly or drilling string having drilling string components of varying diameter. A stationary housing is designed to support a bearing assembly and a clamp cooperates with the housing to secure the bearing assembly in the housing. Chilled water and/or antifreeze may be circulated through the top inner barrel seal of the bearing assembly and lubricant is pumped into the top seal for lubricating the seals and bearings that facilitate rotation of the stripper rubber seals, kelly and drilling string with respect to the stationary housing and pressurize the inner barrel seals and bearings to at least partially offset well pressure.

12 Claims, 5 Drawing Sheets

U.S. PATENT DOCUMENTS

| | | | |
|---|---|---|---|
| 2,175,648 | 10/1939 | Roach | 166/14 |
| 2,176,355 | 10/1939 | Otis | 255/1 |
| 2,185,822 | 1/1940 | Young | 285/97.6 |
| 2,199,735 | 5/1940 | Beckman | 255/1 |
| 2,222,082 | 11/1940 | Leman et al. | 255/1 |
| 2,233,041 | 2/1941 | Alley | 166/14 |
| 2,243,340 | 5/1941 | Hild | 255/1 |
| 2,243,439 | 5/1941 | Pranger et al. | 255/1 |
| 2,287,205 | 6/1942 | Stone | 286/16 |
| 2,303,090 | 11/1942 | Pranger et al. | 255/19 |
| 2,313,169 | 3/1943 | Penick et al. | 166/14 |
| 2,325,556 | 7/1943 | Taylor, Jr. et al. | 309/4 |
| 2,338,093 | 6/1944 | Caldwell | 255/23 |
| 2,480,955 | 9/1949 | Penick | 235/22 |
| 2,506,538 | 5/1950 | Bennett | 255/23 |
| 2,529,744 | 11/1950 | Schweitzer | 286/16 |
| 2,609,836 | 9/1952 | Knox | 137/618 |
| 2,628,852 | 2/1953 | Voytech | 286/11.14 |
| 2,646,999 | 7/1953 | Barske | 286/9 |
| 2,649,318 | 8/1953 | Skillman | 286/19 |
| 2,731,281 | 1/1956 | Knox | 286/16.1 |
| 2,746,781 | 5/1956 | Jones | 288/2 |
| 2,760,750 | 8/1956 | Schweitzer, Jr. et al. | 251/2 |
| 2,760,795 | 8/1956 | Vertson | 286/11.15 |
| 2,764,999 | 10/1956 | Stanbury | 138/31 |
| 2,808,229 | 10/1957 | Bauer et al. | 255/2.5 |
| 2,808,230 | 10/1957 | McNeil et al. | 255/2.5 |
| 2,846,178 | 8/1958 | Minor | 251/2 |
| 2,846,247 | 8/1958 | Davis | 286/16.1 |
| 2,853,274 | 9/1958 | Collins | 255/23 |
| 2,886,350 | 5/1959 | Horne | 286/9 |
| 2,904,357 | 9/1959 | Knox | 286/16.1 |
| 2,927,774 | 3/1960 | Ormsby | 255/23 |
| 2,995,196 | 8/1961 | Gibson et al. | 175/7 |
| 3,023,012 | 2/1962 | Wilde | 277/31 |
| 3,029,083 | 4/1962 | Wilde | 277/164 |
| 3,033,011 | 5/1962 | Garrett | 64/11 |
| 3,052,300 | 9/1962 | Hampton | 166/84 |
| 3,128,614 | 4/1964 | Auer | 64/23.5 |
| 3,176,996 | 4/1965 | Barnett | 277/2 |
| 3,216,731 | 11/1965 | Dollison | 277/1 |
| 3,225,831 | 12/1965 | Knox | 166/75 |
| 3,268,233 | 8/1966 | Brown | 277/31 |
| 3,285,352 | 11/1966 | Hunter | 175/214 |
| 3,323,773 | 6/1967 | Walker | 251/1 |
| 3,387,851 | 6/1968 | Cugini | 277/2 |
| 3,400,938 | 9/1968 | Williams | 277/31 |
| 3,472,518 | 10/1969 | Harlan | 277/31 |
| 3,492,007 | 1/1970 | Jones | 277/31 |
| 3,529,835 | 9/1970 | Lewis | 277/2 |
| 3,621,912 | 11/1971 | Wooddy, Jr. | 166/0.5 |
| 3,631,834 | 1/1972 | Gardner | 115/34 |
| 3,653,350 | 4/1972 | Koons | 114/0.5 |
| 3,661,409 | 5/1972 | Brown et al. | 285/82 |
| 3,667,721 | 6/1972 | Vujasinovic | 251/1 |
| 3,724,862 | 4/1973 | Biffle | 277/31 |
| 3,868,832 | 3/1975 | Biffle | 166/82 X |
| 3,934,887 | 1/1976 | Biffle | 277/31 |
| 3,965,987 | 6/1976 | Biffle | 166/315 |
| 3,999,766 | 12/1976 | Barton | 277/28 |
| 4,037,890 | 7/1977 | Kurita et al. . | |
| 4,098,341 | 7/1978 | Lewis | 166/314 |
| 4,143,880 | 3/1979 | Bunting et al. | 277/31 |
| 4,143,881 | 3/1979 | Bunting | 277/31 |
| 4,154,448 | 5/1979 | Biffle | 277/31 |
| 4,157,186 | 6/1979 | Murray et al. | 277/31 |
| 4,208,056 | 6/1980 | Biffle | 277/31 |
| 4,281,724 | 8/1981 | Garrett | 175/195 |
| 4,285,406 | 8/1981 | Garrett | 175/195 |
| 4,293,047 | 10/1981 | Young | 175/195 |
| 4,304,310 | 12/1981 | Garrett | 175/195 |
| 4,312,404 | 1/1982 | Morrow | 166/84 |
| 4,361,185 | 11/1982 | Biffle | 166/84 |
| 4,363,357 | 12/1982 | Hunter | 166/84 |
| 4,367,795 | 1/1983 | Biffle | 166/84 |
| 4,383,577 | 5/1983 | Pruitt | 166/95 |
| 4,398,599 | 8/1983 | Murray | 166/95 |
| 4,406,333 | 9/1983 | Adams | 175/209 |
| 4,416,340 | 11/1983 | Bailey | 175/195 |
| 4,441,551 | 4/1984 | Biffle | 166/84 |
| 4,444,401 | 4/1984 | Roche et al. | 277/30 |
| 4,448,255 | 5/1984 | Shaffer et al. | 166/387 |
| 4,480,703 | 11/1984 | Garrett | 175/195 |
| 4,486,025 | 12/1984 | Johnston | 277/31 |
| 4,526,243 | 7/1985 | Young | 166/84 X |
| 4,529,210 | 7/1985 | Biffle | 277/31 |
| 4,531,580 | 7/1985 | Jones | 166/84 |
| 4,618,314 | 10/1986 | Hailey | 417/53 |
| 4,697,484 | 10/1987 | Klee et al. | 82/1.5 |
| 4,745,970 | 5/1988 | Bearden | 165/84 |
| 4,754,820 | 7/1988 | Watts et al. | 175/195 |
| 4,783,084 | 11/1988 | Biffle | 277/9 |
| 4,825,938 | 5/1989 | Davis | 166/84 |
| 4,828,024 | 5/1989 | Roche | 166/84 |
| 4,949,796 | 8/1990 | Williams | 175/209 |
| 5,022,472 | 6/1991 | Bailey et al. | 175/195 |
| 5,137,084 | 8/1992 | Gonzales et al. | 166/84 |
| 5,178,215 | 1/1993 | Yenulis et al. | 166/80 |
| 5,213,158 | 5/1993 | Bailey et al. | 166/82 |
| 5,224,557 | 7/1993 | Yenulis et al. | 175/195 |

ROTATING BLOWOUT PREVENTER

This application is a continuation of application Ser. No. 08/653,597 filed May 24, 1996, now abandoned, which is a continuation of application Ser. No. 08/564,933 filed Nov. 30, 1995, now abandoned, which is a continuation of application Ser. No. 08/489,233 filed Jun. 12, 1995, now abandoned, which is a continuation of application Ser. No. 08/310,035 filed Sep. 21, 1994, now abandoned, which is a continuation of application Ser. No. 07/954,285 filed Sep. 30, 1992, now abandoned.

BACKGROUND OF THE INVENTION

1. Field of the Invention

This invention relates to drilling heads and blowout preventors for oil and gas wells and more particularly, to a rotating blowout preventor mounted on the wellhead or on primary blowout preventors bolted to the wellhead, to pressure-seal the interior of the well casing and permit forced circulation of drilling fluid through the well during drilling operations. The rotating blowout preventor of this invention includes a housing which is designed to receive a blowout preventor bearing assembly and a hydraulic cylinder-operated clamp mechanism for removably securing the bearing assembly in the housing and providing ready access to the components of the bearing assembly and dual stripper rubbers provided in the bearing assembly. A conventional drilling string is inserted or "stabbed" through the blowout preventor bearing assembly, including the two base stripper rubber units rotatably mounted in the blowout preventor bearing assembly, to seal the drilling string. The device is designed such that chilled water and/or antifreeze may be circulated through a top pressure seal packing box in the blowout preventor bearing assembly and lubricant is introduced into the top pressure seal packing box for lubricating top and bottom pressure seals, as well as stacked radial and thrust bearings.

Primary features of the rotating blowout preventor of this invention include the circulation of chilled water and/or antifreeze into the top seal packing box and using a hydraulically-operated clamp to secure the blowout preventor bearing assembly in the stationary housing, to both cool the pressure seals and provide access to the spaced rotating stripper rubbers and internal bearing assembly components, respectively. The clamp can be utilized to facilitate rapid assembly and disassembly of the rotating blowout preventor. Another primary feature is mounting of the dual stripper rubbers in the blowout preventor bearing assembly on the fixed housing to facilitate superior sealing of the stripper rubbers on the kelly or drilling string during drilling or other well operations. Still another important feature is lubrication of the respective seals and bearings and offsetting well pressure on key shaft pressure seals by introducing the lubricant under pressure into the bearing assembly top pressure seal packing box.

Oil, gas, water and geothermal wells are typically drilled with a drill bit connected to a hollow drill string which is inserted into a well casing cemented in the well bore. A drilling head is attached to the well casing, wellhead or to associated blowout preventor equipment, for the purposes of sealing the interior of the well casing from the surface and facilitating forced circulation of drilling fluid through the well while drilling. In the more commonly used forward circulation drilling technique, drilling fluid is pumped downwardly through the bore of the hollow drill string, out the bottom of the bore and then upwardly through the annulus defined by the drill string and the interior of the well casing and subsequently, from the drill string side outlet at the housing. In reverse circulation, the drilling fluid is pumped directly through the side outlet and the annulus between the drill string and the well casing and subsequently upwardly through the drill string bore and from the well.

Prior art drilling heads typically include a stationary body which carries a rotatable spindle operated by a kelly apparatus. One or more seals or packing elements, sometimes referred to as stripper packers or stripper rubbers, is carried by the spindle to seal the periphery of the kelly or the drive tube or sections of the drill pipe, whichever may be passing through the spindle, and thus confine the fluid pressure in the well casing to prevent the drilling fluid from escaping between the rotating spindle and the drilling string. As modern wells are drilled to ever deeper depths, greater temperatures and pressures are encountered, thus sometimes causing steam or hot water vapor at the drilling head. These rigorous drilling conditions pose increased risks to rig personnel from accidental scalding, burns or contamination by steam, hot water and hot, caustic well fluids.

2. Description of the Prior Art

Among the patents which relate to rotating blowout preventors are the following: U.S. Pat. No. 4,783,084, dated Nov. 8, 1988, to Biffle; U.S. Pat. No. 3,965,987, dated Jun. 29, 1976, also to Biffle; U.S. Pat. No. 3,868,832, dated Mar. 4, 1975, also to Biffle; U.S. Pat. No. 4,406,333, dated Sep. 27, 1983 to Adams; U.S. Pat. No. 4,423,776, dated Jan. 3, 1984, to Wagoner, et al; U.S. Pat. No. 4,304,310, dated Dec. 8, 1981, to Garrett; U.S. Pat. No. 4,157,186, dated Jun. 5, 1979, to Murray, et al; U.S. Pat. No. 4,312,404, dated Jan. 26, 1982, to Morrow; U.S. Pat. No. 4,398,599, dated Aug. 16, 1983, to Murray; and U.S. Pat. No. 3,128,614, dated Apr. 14, 1964, to L. S. Auer.

It is an object of this invention to provide a rotating blowout preventor which is characterized by a blowout preventor housing, a clamp mounted on the housing and the housing attached to the well casing, wellhead or other blowout preventor equipment to facilitate removably mounting a blowout preventor bearing assembly in the housing on a housing gasket, while drilling or servicing the well.

Another object of this invention is to provide a dual stripper rubber rotating blowout preventor for containing internal well pressure at the well head, which rotating blowout preventor includes fluid ports communicating with top pressure seals for cooling, lubricating and exerting pressure on the pressure seals and at least partially offsetting well pressure application to the lower pressure seals to minimize deformation and failure of the pressure seals.

A still further object of this invention is to provide a new and improved rotating blowout preventor which is characterized by a blowout preventor bearing assembly fitted with at least two vertically spaced stripper rubber seals, the top stripper rubber seal of which is mounted in a rotating top rubber pot attached to a rotatable inner barrel and the bottom stripper rubber also secured to the rotating inner barrel in the blowout preventor and further including a clamp which is capable of tightening on the blowout preventor housing and bearing assembly to removably secure the bearing assembly inside the housing against a housing gasket.

SUMMARY OF THE INVENTION

These and other objects of the invention are provided in a rotating blowout preventor for containing the internal pressure of a well at the well head during well operations, which rotating blowout preventor includes, in a most preferred embodiment, a blowout preventor bearing assembly seated on a housing gasket in a fixed housing, a hydraulically-operated clamp mechanism mounted on the fixed housing and engaging the bearing assembly in mounted configuration, which housing is attached to the well casing, wellhead or primary blowout preventor, a vertical inner barrel rotatably mounted in the bearing assembly and receiving a pair of pressure-sealing stripper rubbers and cooling fluid and lubricating inlet ports communicating with top pressure seals for circulating chilled water and/or antifreeze through the top seals and forcing lubricant into stacked shaft bearings and seals to exert internal pressure on the seals and especially, the lower seals.

BRIEF DESCRIPTION OF THE DRAWINGS

The invention will be better understood by reference to the accompanying drawings, wherein.

DESCRIPTION OF THE PREFERRED EMBODIMENTS

Figure 1:
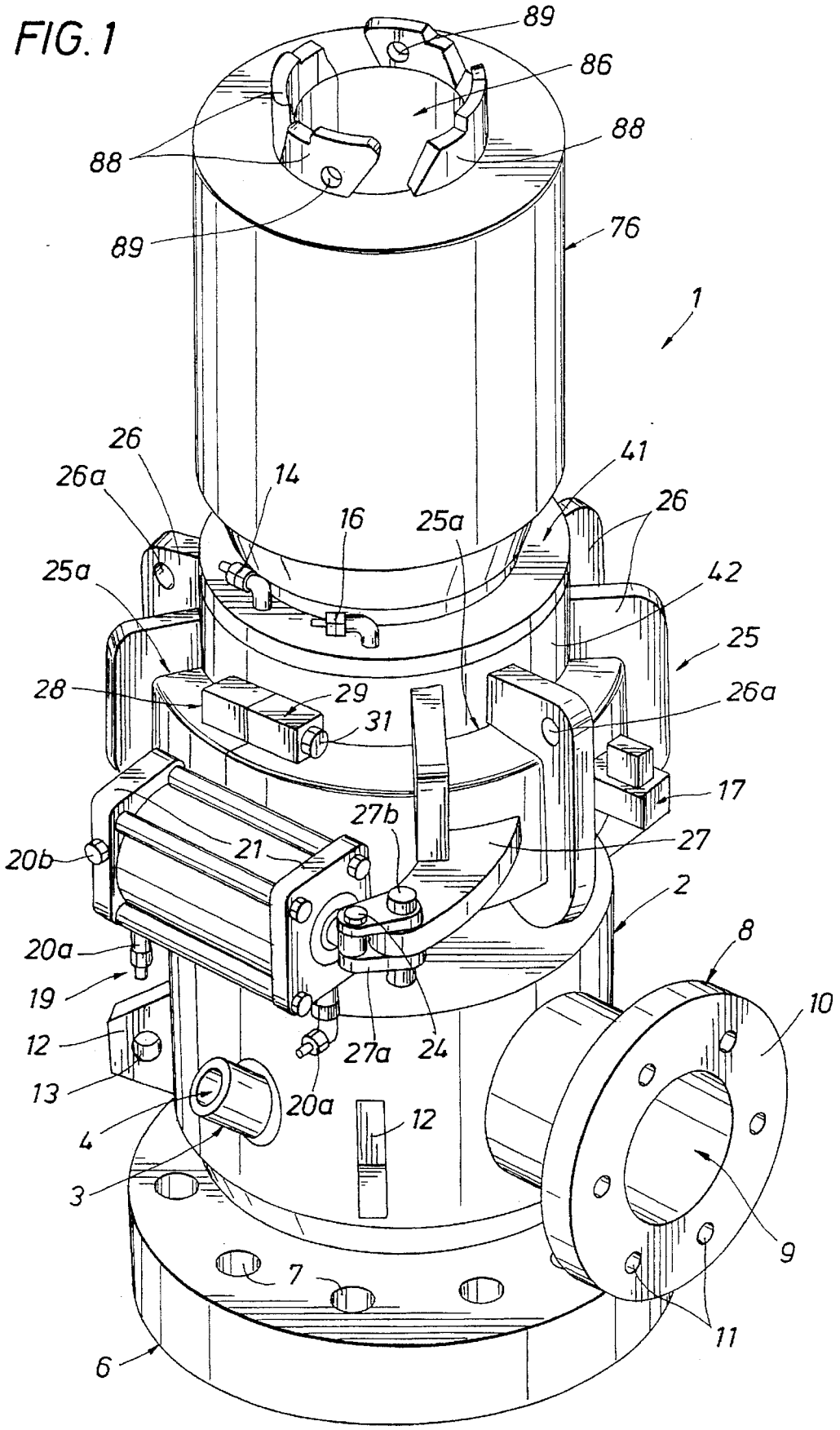
FIG. 1 is a perspective view of a preferred embodiment of the rotating blowout preventor of this invention.
Figure 2:
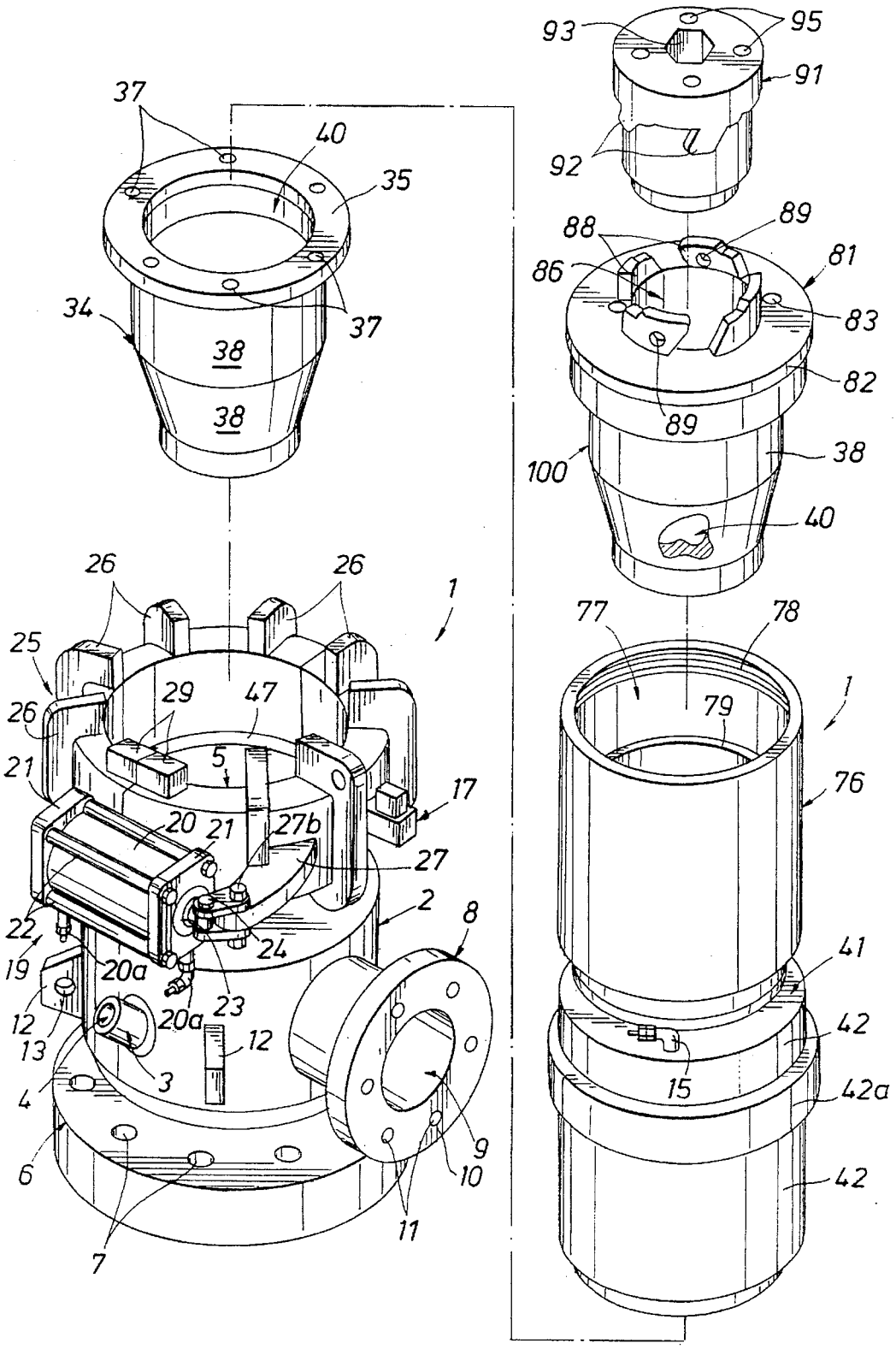
FIG. 2 is an exploded view of the rotating blowout preventor illustrated in FIG. 1.

Referring initially to FIGS. 1 and 2, in a preferred embodiment the rotating blowout preventor of this invention is generally illustrated by reference numeral 1. The rotating blowout preventor 1 is characterized by a housing 2, which is mounted on a conventional casing, wellhead or primary blowout preventor equipment (not illustrated) of a well (not illustrated), according to the knowledge of those skilled in the art. The housing 2 is characterized by an internal housing gasket 47, a mud fill line 3, having a mud fill line bore 4 for injecting drilling mud (not illustrated) into the housing bore 5 of the housing 2 and circulating the drilling mud through the drill string annulus and drill string (not illustrated), further according to the knowledge of those skilled in the art. A return outlet 8, having a return outlet bore 9, is also provided in the housing 2 in conventional fashion for diverting well bore debris, according to the knowledge of those skilled in the art, and is fitted with a return outlet flange 10, having return outlet flange openings 11. Housing flange openings 7 are provided in the conventional housing flange 6 for bolting the housing 2 to a casing, wellhead or blowout preventor. Stabilizing flanges 12 are provided in radially-spaced relationship on the housing 2, in order to stabilize the rotating blowout preventor 1 during installation. Each stabilizing flange 12 is fitted with a stabilizing flange opening 13 for insertion of a rod or tool to manipulate the housing 2 into position, as deemed necessary. A pair of clamp stops 17 are welded or otherwise attached to the housing 2 and project upwardly and outwardly from the housing 2 in 180° disposed relationship, for a purpose which will be hereinafter further described.

Figure 3:
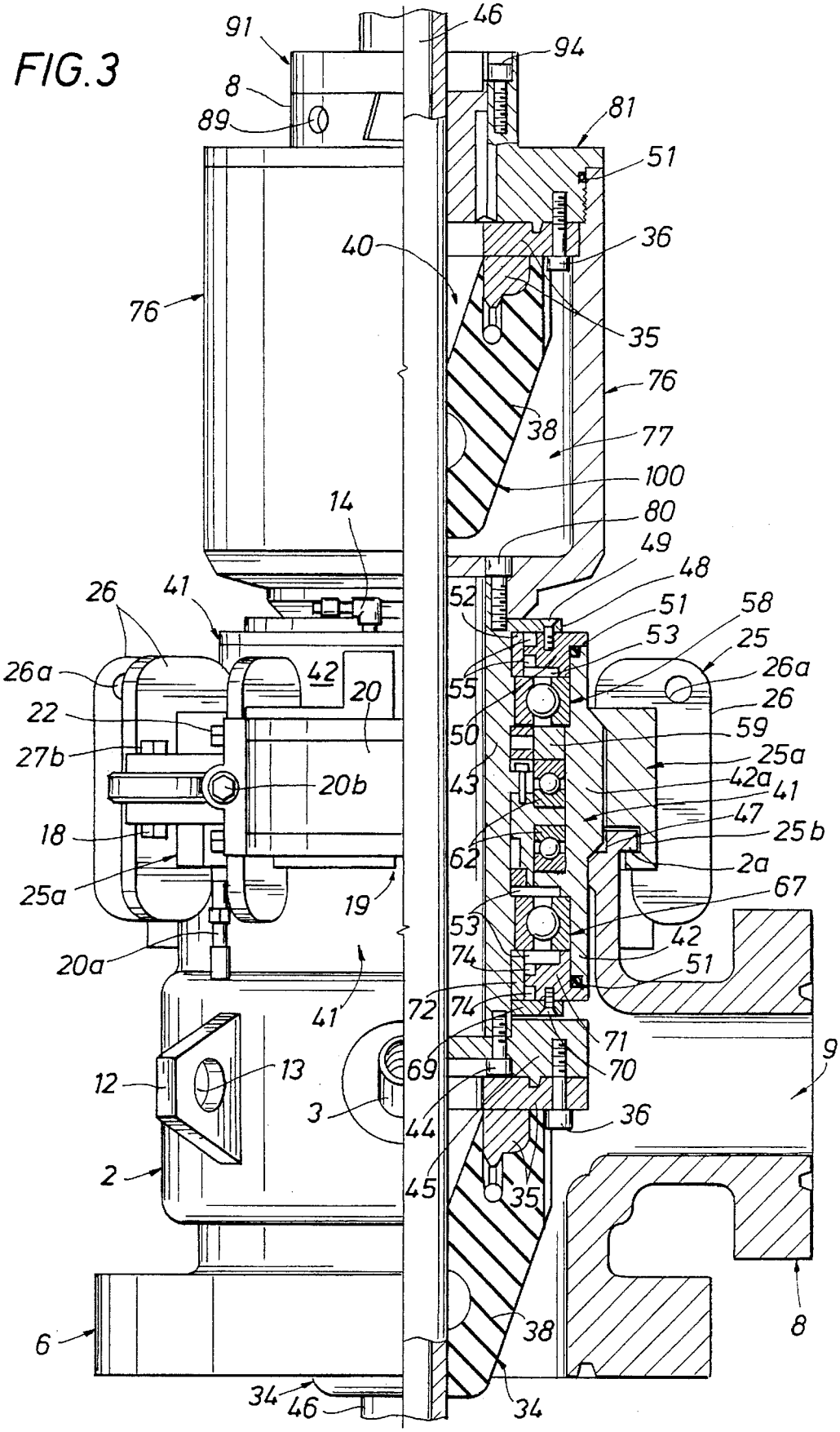
FIG. 3 is a quarter sectional view of the rotating blowout preventor illustrated in FIG. 1.
Figure 4:
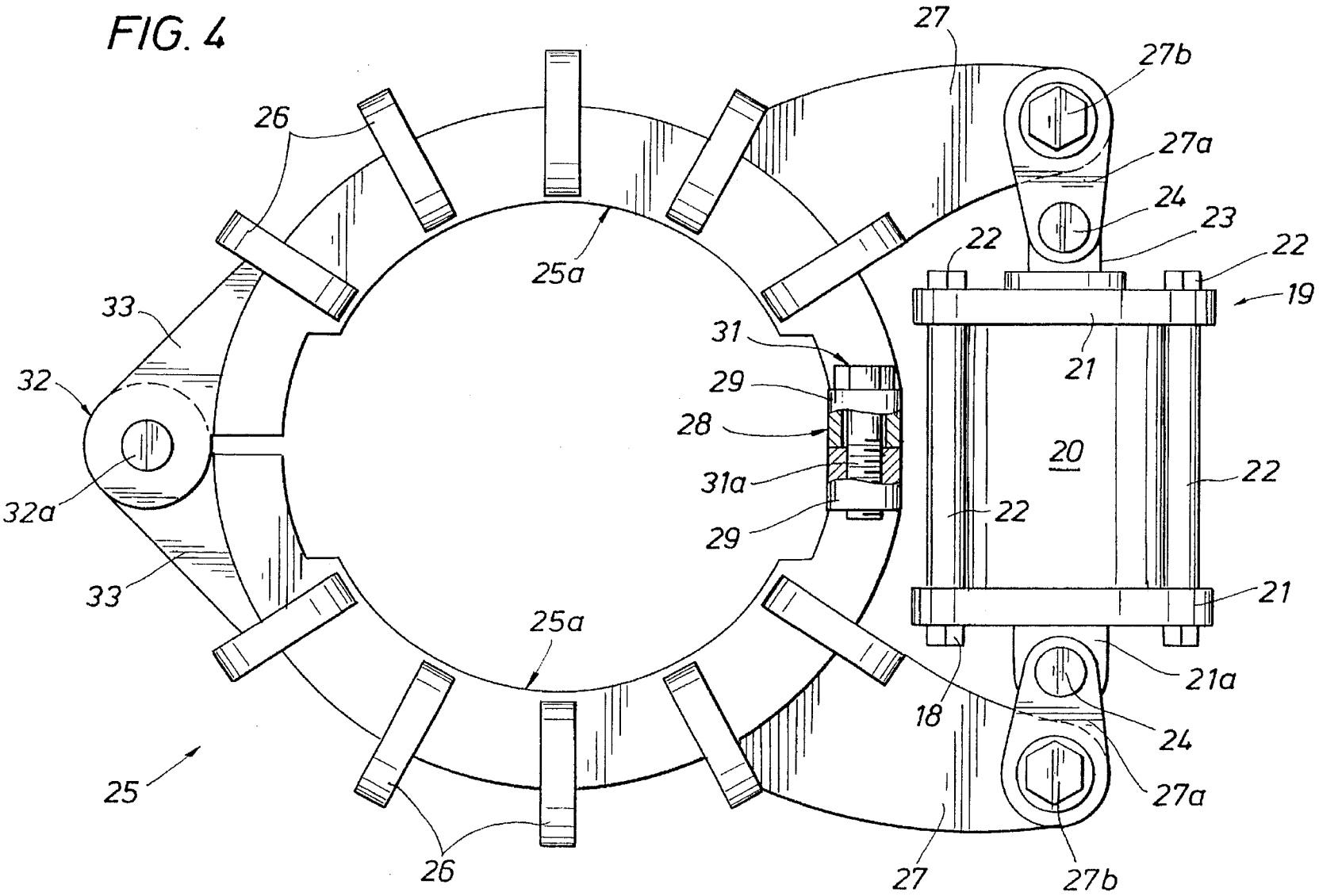
FIG. 4 is a top view of a closed clamp element of the rotating blowout preventor illustrated in FIG. 1.
Figure 5:
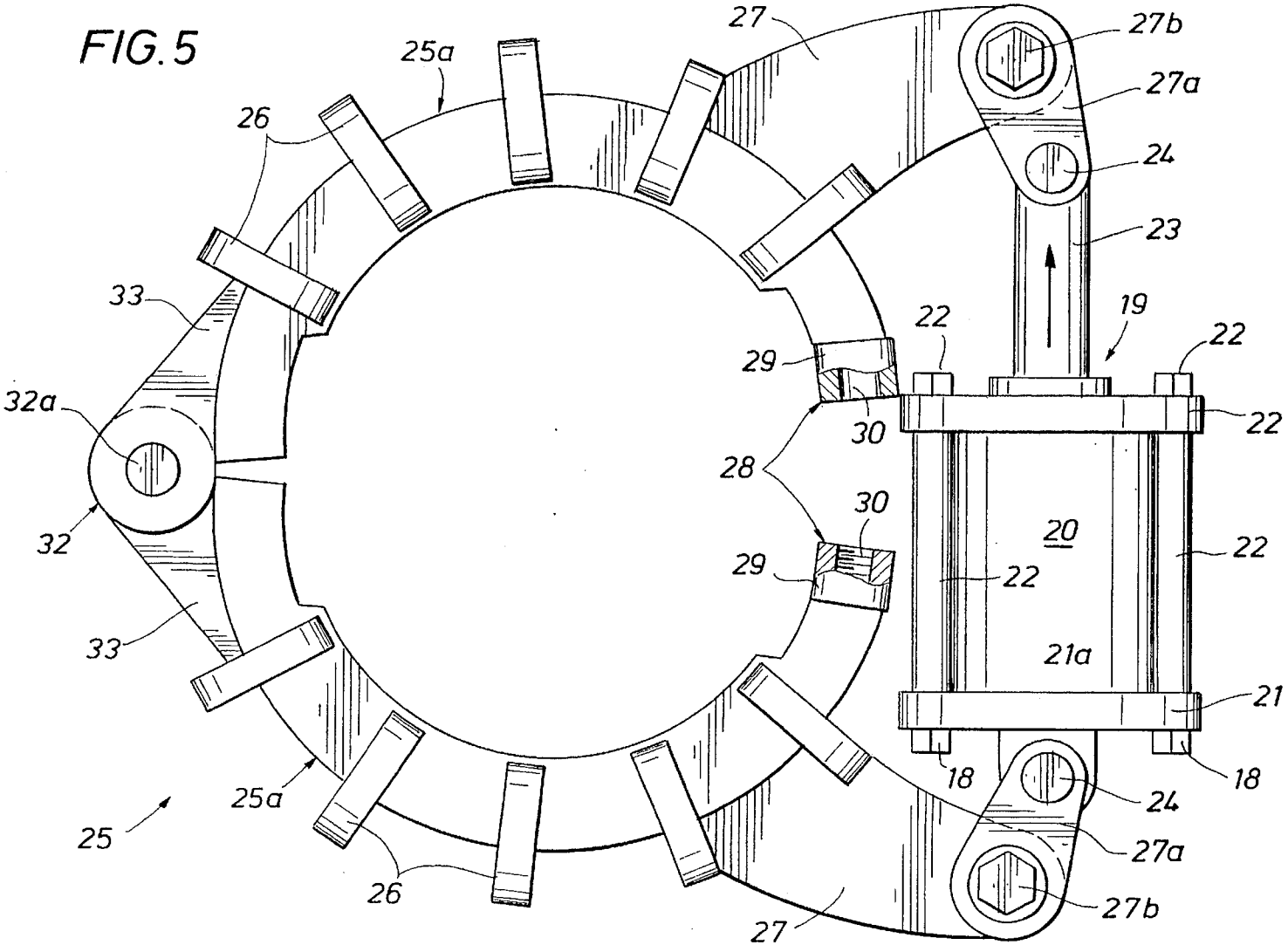
FIG. 5 is a top view of an open clamp element of the rotating blowout preventor assembly.

Referring now to FIGS. 1–5 of the drawings, a clamp 25 encircles the housing 2 and includes a pair of curved clamp segments **25*a*, attached at one end by means of a clamp hinge 32 and hinge pin 32*a* and fitted with a clamp lock 28 at the opposite ends thereof. Each clamp segment 25*a* is also fitted with a continuous segment slot 25*b*, which receives a corresponding continuous housing flange 2*a*, as illustrated in FIG. 3, for securing the clamp segments 25*a* against an outer barrel collar 42*a* and on the housing 2. The clamp lock 28 includes a pair of lock segments 29, one of which is fitted with internal segment threads 30 and adapted to receive a threaded lock bolt 31, having bolt threads 31*a* that engage the segment threads 30 of the respective lock segments 29 and secure the clamp 25 in locked configuration, as illustrated in FIGS. 4 and 5. Each of the clamp segments 25*a* is also fitted with spaced stiffening clamp flanges 26, two of which are fitted with lifting sling holes 26*a*, and in a preferred embodiment of the invention, hinge gussets 33 are provided on the clamp hinge 32 and clamp segments 25*a* for strengthening the connection between the respective clamp segments 25*a* and the clamp hinge 32. A clamp segment arm 27 extends from each of the clamp segments 25*a* near the clamp lock 28 and projects forwardly for attachment to a corresponding arm plate 27*a*, by means of a companion arm plate bolt 27*b*. One of the arm plates 27*a* is attached to the cylinder piston 23 of a clamp cylinder 19 and the opposite arm plate 27*a* is secured to a plate bracket 21*a*, which is mounted on one of a pair of cylinder housing plates 21, located on each end of the cylinder housing 20 of the clamp cylinder 19. A connecting pin 24 pivotally connects one of the arm plates 27*a* to the plate bracket 21*a* and the opposite arm plate 27*a* to the corresponding cylinder piston 23. Furthermore, the arm plate bolts 27*b* are designed to facilitate pivotal attachment of the respective clamp segment arms 27 and the corresponding arm plates 27*a* to allow pivoting action between the respective arm plates 27*a* and clamp segment arms 27, responsive to extension and retraction of the cylinder piston 23 in the cylinder housing 20. This action opens and closes the clamp 25, as illustrated in FIGS. 4 and 5. When the clamp 25 is in the closed configuration as illustrated in FIGS. 1 and 4, the lock bolt 31 may be inserted in the lock segments 29 to secure the clamp lock 28 and prevent inadvertent opening of the clamp 25 by unintentional operation of the clamp cylinder 19. In a preferred embodiment of the invention the clamp cylinder 19 is designed such that the cylinder housing 20 is sandwiched between the spaced cylinder housing plates 21 and is maintained in that position by means of housing plate bolts 22, secured by nuts 18, as further illustrated in FIGS. 4 and 5**.

Referring now to FIGS. 2, 3 and 5 of the drawings, the housing 2 is designed to receive a bearing assembly 41, topped by a top rubber pot 76, when the clamp 25 is in the open configuration as illustrated in FIG. 5. The top rubber pot 76 includes a pot chamber 77, having pot threads 78 at the top inner periphery thereof and a pot chamber shoulder 79 extending below the pot threads 78, as further illustrated in FIG. 2. The pot chamber 77 is designed to receive a top stripper rubber 100, which includes a rubber body 38, secured to a metal insert 35, which is attached to a top rubber drive 81, having an o-ring 51 and rubber drive threads 82 and fitted with upward-standing drive lugs 88. Oppositely-disposed pairs of the shaped drive lugs 88 may be fitted with spanner holes 89 for insertion of a rod or tool to tighten the top rubber drive 81 on the top rubber pot 76 and seal the top rubber drive 81 by means of the o-ring 51 when the top stripper rubber 100 is lowered into the pot chamber 77 and the rubber drive threads 82 engage the corresponding pot threads 78, as illustrated in FIGS. 2 and 3. A top rubber drive kelly opening 86 is provided in the center of the top rubber drive 81 and communicates with a stripper rubber bore 40, extending through the top stripper rubber 100, for receiving a drill string and kelly, as hereinafter further described.

Rubber drive holes 83 facilitate insertion of a tightening tool (not illustrated) and tightening the top rubber drive 81 on the top rubber pot 76. The kelly driver 91 is fitted with spaced driver lugs 92, shaped to engage slots between the respective upward-standing drive lugs 88 in the top rubber drive 81 and the driver bolts 94 assemble the kelly driver 91, as illustrated in FIG. 3. In a preferred embodiment of the invention and referring again to FIG. 3 of the drawings, the top stripper rubber 100 is molded with the metal insert 35 and is mounted to the top rubber drive 81 by means of spaced insert bolts 36. This mounting facilitates insertion of the top stripper rubber 100 and top rubber drive 81 in concert in the pot chamber 77 of the top rubber pot 76, as illustrated in FIGS. 2 and 3.

As further illustrated in FIGS. 2 and 3, the top end of an inner barrel 43, rotatably mounted in the bearing assembly 41, receives the top rubber pot 76 by means of spaced pot mount bolts 80, as illustrated in FIG. 3. The bottom end of the inner barrel 43 receives a bottom stripper rubber 34 which, like the top stripper rubber 100, has a stripper rubber bore 40 and is fitted with a metal insert 35, provided with spaced insert openings 37. Preferably, the rubber body 38 of the bottom stripper rubber 34 is secured to the metal insert 35 by means of a molding process and the metal insert 35 is, in turn, attached to a bottom rubber mount ring 45 by means of spaced insert bolts 36. The bottom rubber mount ring 45 is secured to the bottom of the inner barrel 43 by means of spaced bottom rubber mount bolts 44, as illustrated in FIG. 3. Accordingly, it will be appreciated from a consideration of FIG. 3 of the drawings that the top stripper rubber 100 and bottom stripper rubber 34 are rotatably mounted on opposite ends of the inner barrel 43 in vertically aligned relationship in the rotating blowout preventor 1 to receive a kelly 46 that projects through the kelly driver 91, top rubber drive 81, stripper rubber bore 40 of the top stripper rubber 100, inner barrel 43, stripper rubber bore 40 of the bottom stripper rubber 34 and from the bottom of the housing 2. Consequently, rotation of the kelly 46 in the drilling operation also rotates the top rubber pot 76, top stripper rubber 100, inner barrel 43 and bottom stripper rubber 34, while the outer barrel 42 and housing 2 remain stationary.

Referring again to FIGS. 1–3 of the drawings, a water inlet fitting 14, illustrated in FIGS. 1 and 3 and a water outlet fitting 15, illustrated in FIG. 2, are seated in the bearing assembly 41 and are provided in communication with a passage (not illustrated) provided in the top packing box 50, which houses a pair of top seals 55, secured between the fixed outer barrel 42 and the rotatable inner barrel 43 of the bearing assembly 41. Accordingly, chilled water and/or antifreeze may be circulated through the water inlet fitting 14 into the passage and from the water outlet fitting 15 to cool the top seals 55. Similarly, a lubricant inlet fitting 16 is also tapped into the bearing assembly 41 to facilitate pressurized insertion of lubricant into a lube fissure 53, lying adjacent to the top seals 55 for lubricating not only the top seals 55, but also a top radial bearing 58 located immediately beneath the top seals 55, a pair of thrust bearings 62, spaced from the top radial bearing 58 by a thrust nut 59 and a bottom radial bearing 67, as well as a pair of bottom seals 74, positioned in a bottom packing box 71 beneath the bottom radial bearing 67. Additional lube fissures 53 are provided above and below the bottom radial bearing 67. A top wear sleeve 52 is seated against the inner barrel 43 and lies adjacent to the top seals 55, while spaced top plate bolts 49 serve to secure a top plate 48 to the top packing box 50 which encloses the top seals 55 at the top end of the inner barrel 43. Similarly, at the bottom end of the inner barrel 43, the bottom seals 74 are secured in place against a bottom wear sleeve 72 by means of bottom plate bolts 70, that attach a bottom plate 69 to a corresponding bottom packing box 71, enclosing the bottom seals 74. Lubricant from the top lube fissure 53 flows downwardly by application of pressure through the top radial bearing 58, thrust bearings 62 and bottom radial bearing 67, into the bottom lube fissures 53, to thoroughly lubricate the internal sealing components of the bearing assembly 41. As further illustrated in FIG. 3, an o-ring 51 is seated in each end of the outer barrel 42 and in the top packing box 50 and bottom packing box 71, respectively, to seal the top packing box 50 and bottom packing box 71 on each end of the outer barrel 42 responsive to tightening of the respective top plate bolts 49 and bottom plate bolts 70.

In operation, the housing 2 of the rotating blowout preventor 1 is initially bolted to a casing or the like in conventional fashion and assembled by first removing the lock bolt 31 from engagement with the corresponding lock segments 29 of the clamp lock 28 and activating the clamp cylinder 19 by means of suitable accessories and controls (not illustrated) which are well known to those skilled in the art. Operating fluid is then caused to flow selectively through the housing fittings 20*a*, illustrated in FIG. 1, to extend the cylinder piston 23 and open the clamp 25 from the position illustrated in FIG. 4 to the position illustrated in FIG. 5. This operation facilitates insertion of the bearing assembly 41 and connected top rubber pot 76 into the housing 2, through the open clamp 25, to seat the outer barrel collar 42*a* tightly against the housing gasket 47. Uniform opening of the clamp 25 responsive to operation of the clamp cylinder 19 is achieved by initial sliding movement of the right-hand clamp segment 25*a* (as viewed in FIG. 1) on the housing flange 2*a* of the housing 2, illustrated in FIG. 3, by contact between a right-hand clamp flange 26 and the right-hand clamp stop 17, which movement forces sliding movement of the left-hand clamp segment 25*a* on the corresponding housing flange 2*a* of the housing 2. When the bearing assembly 41 is seated against the housing gasket 47 in the housing 2 as illustrated in FIGS. 1 and 3, the clamp cylinder 19 is again actuated, thereby closing the clamp 25 from the position illustrated in FIG. 5 to the position illustrated in FIG. 4 and forcing the clamp segments 25*a* against the outer barrel collar 42*a*, to seal the outer barrel collar 42*a* against the housing gasket 47. The lock bolt 31 is then threadably reinserted in the respective lock segments 29 of the clamp lock 28 and the rotating blowout preventor 1 is ready to receive a kelly 46, after mounting the kelly driver 91 on the kelly 46. The kelly 46 is subsequently "stabbed" into the top rubber drive kelly opening 86 and through the top stripper rubber 100 and the bottom stripper rubber 34, as illustrated in FIG. 3. The housing 2 is then stabilized, if necessary, utilizing the stabilizing flanges 12, in conventional fashion. Drilling of the well may then be accomplished by rotating the kelly 46, also in conventional fashion and the bearing assembly 41 is removably sealed in the housing 2 on the housing gasket 47 against well pressure.

The rotating blowout preventor of this invention alleviates a common problem realized in operating blowout preventors and rotating blowout preventors in particular, which is the requirement of changing bearings, stripper rubbers and effecting other maintenance to the internal parts of the rotating blowout preventor. This problem is minimized in the rotating blowout preventor of this invention by simple operation of the clamp 25 to provide access to all of the internal parts of the bearing assembly 41, including the removable housing gasket 47, top stripper rubber 100 and bottom stripper rubber 34. Furthermore, the top seals 55 are maintained in a cooler condition by circulating chilled water and/or antifreeze through the top packing box 50, and lubricant charged into the top packing box 50 under pressure is designed to lubricate not only the top seals 55, but also the top radial bearing 58, thrust bearings 62, bottom radial bearing 67 and bottom seal 74 and to lengthen seal and bearing life by at least partially offsetting well pressure, particularly in the lower seals. The rotating blowout preventor 1 is therefore designed to withstand high well pressures in a highly efficient manner with low maintenance down time.

It will be further appreciated that although a single pair of stripper rubbers are described for use in the rotating blowout preventor of this invention, in a most preferred embodiment, additional stripper rubbers may be added, as desired. Accordingly, while the preferred embodiments of the invention have been described above, it will be recognized and understood that various modifications may be made therein and the appended claims are intended to cover all such modifications without departing from the spirit and scope of the invention.

Having described my invention with the particularity set forth above, what is claimed is:

1. A rotating blowout preventor for an oil or gas well for resiliently engaging a drill string extending therethrough, comprising:

a housing having a housing opening;

a bearing assembly removably seated in said housing opening and having a passage, through which passage a drill string may extend;

said bearing assembly having an outer generally cylindrical barrel and an inner generally cylindrical barrel having bearing elements positioned therebetween such that said inner barrel is mounted for rotation with respect to said outer barrel;

a clamp assembly for engaging said housing and said outer barrel for removably securing said bearing assembly;

a top rubber pot mounted on said inner barrel for rotation therewith;

a first downwardly-converging seal mounted within said top rubber pot and having resilient engaging means for sealably engaging the drill string, said first downwardly-converging seal adapted to rotate in sealing engagement with the drill string;

a second downwardly-converging seal mounted on said inner barrel in spaced relationship with respect to said first downwardly-converging seal and adapted to rotate in sealing engagement with said drill string; and said bearing assembly, top rubber pot, first downwardly-converging seal, said second downwardly-converging seal being removable as a unit for ease of replacement.

2. The rotating blowout preventor of claim 1, wherein said clamp assembly further comprises a pair of curved clamp segments for engaging said housing, each of said curved clamp elements having first and second ends;

a hinge connecting said first ends of said clamp segments and a fluid cylinder operatively connected to said second ends of clamp segments for selectively opening and closing said clamp segments on said hinge to access said housing opening.

3. The rotating blowout preventor of claim 2, further comprising:

a clap lock mounted on said second ends of said clamp segments for mechanically locking said clamp segments in a closed position on said housing.

4. The rotating blowout preventor of claim 3, wherein:

said clamp lock further comprises an internally-threaded lock segment mounted on said second end of one of said clamp segments and a lock bolt mounted on said second end of said other clamp segment for threadably engaging said lock segment and securing said clamp segments on said housing.

5. The rotating blowout preventor of claim 1, further comprising:

a top seal mounted between said inner barrel and said outer barrel and fluid circulation means for circulating a cooling fluid through said top seal for cooling said top seal.

6. A rotating blowout preventor for sealing a drill siring in a well, comprising:

a housing having an opening provided in said housing;

a bearing assembly removably mounted in said housing opening;

a clamp assembly for engaging said housing and bearing assembly for releasably clamping said bearing assembly in said housing;

said bearing assembly including an inner and outer barrel with one or more bearings provided therebetween, said inner barrel having an inner barrel bore;

top rotatable pot mounted on said inner barrel for rotation therewith;

at least one first downwardly-converging seal mounted within said top rotatable pot;

at least one second downwardly-converging seal attached to said inner barrel for rotating therewith, said second seal being mounted in spaced relationship with respect to said first seal;

said first and said second downwardly-converging seals being adapted to rotate with said inner barrel and in sealing engagement with the drill string;

a top pressure seal provided in said bearing assembly and for sealing between said inner and outer barrel; and means mounted in said bearing assembly for applying cooling fluid to said top pressure seal during rotation of said inner barrel.

7. The rotating blowout preventor of claim 6, further comprising:

said inner barrel of said bearing assembly having top and bottom generally cylindrical end portions;

said top rotatable pot being mounted on the upper end portion of said inner barrel, said top rotatable pot being a cylindrical housing and having said first downwardly-converging seal mounted in said pot; and, said second downwardly-converging seal being mounted on the lower end portion of said inner barrel for securing said first downwardly-converging seal and said second downwardly-converging seal to said inner barrel in rotatable relationship with respect to said non-rotating outer barrel of said bearing assembly, said clamp and said housing.

8. The rotating blowout preventor of claim 6, wherein:

said clamp assembly further comprises a pair of curved clamp segments for engaging said housing and said bearing assembly, said clamp segments having first and second ends; and a hinge connecting said first ends of said clamp segments and a fluid cylinder operatively connected to said second ends of said clamp segments for selectively opening and closing said clamp segments on said hinge and accessing said housing opening and said bearing assembly mounted therein.

9. The rotating blowout preventor of claim 8, including:

said housing having first and second stops attached thereto, each of said stops being positioned to receive one of said curved clamp segments as said curved clamp segments are moved to an open position such that said clamp segments are moved to opposing open positions.

10. The rotating blowout preventor of claim 8, further comprising:

a clamp lock provided on said second ends of said clamp segments from said one end for locking said clamp segments in a closed configuration on said housing.

11. The rotating blowout preventor of claim 10, wherein:

said clamp lock further comprises an internally-threaded lock segment mounted on one of said second ends of one of said clamp segments and a lock bolt mounted on said second end of said other clamp segment for threadably engaging said lock segment and securing said clamp segments on said housing and said bearing assembly.

12. The rotating blowout preventor of claim 7, further comprising:

a lubricant inlet provided in said outer barrel of said bearing assembly for selectively applying lubricant pressure to said bearing assembly.

* * * * *